US009988247B2

(12) United States Patent
Iwazawa

(10) Patent No.: US 9,988,247 B2
(45) Date of Patent: Jun. 5, 2018

(54) MOBILE CRANE

(71) Applicant: KOBELCO CONSTRUCTION MACHINERY CO., LTD., Hiroshima-shi (JP)

(72) Inventor: Takahiro Iwazawa, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days. days.

(21) Appl. No.: 15/212,651

(22) Filed: Jul. 18, 2016

(65) Prior Publication Data

US 2017/0022035 A1 Jan. 26, 2017

(30) Foreign Application Priority Data

Jul. 23, 2015 (JP) ..... 2015-145699

(51) Int. Cl.
*B66C 13/20* (2006.01)
*B66C 23/76* (2006.01)

(52) U.S. Cl.
CPC ..... *B66C 13/20* (2013.01); *B66C 23/76* (2013.01)

(58) Field of Classification Search
CPC ..... B66C 23/74; B66C 23/76; B66C 13/20; B66C 2700/0371
See application file for complete search history.

(56) References Cited

U.S. PATENT DOCUMENTS 3,037,643 A * 6/1962 Hermann ..... B66C 23/62 212/301
3,842,984 A * 10/1974 Brown ..... B60G 3/00 212/195
4,382,519 A * 5/1983 Beduhn ..... B66C 23/74 212/195

(Continued)

FOREIGN PATENT DOCUMENTS

JP 62-128083 U 8/1987
JP 62-175399 A 8/1987

(Continued)

OTHER PUBLICATIONS

Office Action dated Apr. 25, 2017 in Japanese Patent Application No. 2015-145699 (with unedited computer generated English translation).

*Primary Examiner* — Emmanuel M Marcelo
(74) *Attorney, Agent, or Firm* — Oblon, McClelland, Maier & Neustadt, L.L.P.

(57) ABSTRACT

A mobile crane includes a counterweight carrier capable of traveling following a movement of a crane main body, the counterweight carrier including a carrier main body on which a counterweight is loaded and a wheel unit attached to the carrier main body and including wheels, a wheel driving device configured to rotate the wheels to thereby cause the counterweight carrier to travel, a loadage detector configured to detect a weight loadage index value, which is an index value of weight of the counterweight loaded on the carrier main body, and a controller configured to cause the wheel driving device to change a driving force of the wheel driving device for rotating the wheels such that the driving force increases as the weight loadage index value detected by the loadage detector increases.

10 Claims, 11 Drawing Sheets

(56) References Cited

U.S. PATENT DOCUMENTS

| | | | | |
|---|---|---|---|---|
| 4,540,097 | A * | 9/1985 | Wadsworth | B66C 23/74 212/178 |
| 4,716,729 | A | 1/1988 | Kakeya | |
| 2014/0116975 | A1 * | 5/2014 | Benton | B66C 23/88 212/302 |

FOREIGN PATENT DOCUMENTS

| | | |
|---|---|---|
| JP | 5-208796 | 8/1993 |
| JP | 2012-101931 A | 5/2012 |

* cited by examiner

MOBILE CRANE

TECHNICAL FIELD

The present invention relates to a mobile crane including a counterweight carrier.

BACKGROUND ART

There has been known a mobile crane including a travelable crane main body and a counterweight carrier capable of traveling following the crane main body. The counterweight carrier is coupled to the crane main body via a coupling member. The counterweight carrier is mounted with a counterweight to increase stability of the crane main body by the weight of the counterweight and improve a hoisting ability of the crane main body.

As such a mobile crane, Japanese Unexamined Patent Publication No. H5-208796 discloses a mobile crane including a lower traveling body, an upper swing body mounted on the lower traveling body to be capable of swing, and a counterweight carrier coupled to a rear part of the upper swing body via a coupling member. The lower traveling body and the upper swing body configure a crane main body. The lower traveling body self-travels according to operation of an operation lever for traveling. The counterweight carrier includes a plurality of wheels and a carrier traveling motor. The carrier traveling motor drives to rotate the wheels according to the operation of the operation lever to thereby enable the counterweight carrier to travel following the crane main body.

The traveling of the counterweight carrier is performed by, for example, driving of the wheels by a hydraulic motor. However, depending on loadage of a counterweight on the counterweight carrier, it is likely that a driving pressure for the driving is excessive or insufficient. Specifically, if the loadage of the counterweight on the counterweight carrier is large, it is likely that the driving pressure is relatively insufficient and the counterweight carrier cannot normally travel. Conversely, if a large driving pressure is set assuming that the loadage of the counterweight on the counterweight carrier is the largest, a loss of energy consumed for the driving is large. It is likely that it is difficult to synchronize a movement of the counterweight carrier with a movement of the crane main body because the driving pressure is excessively large.

SUMMARY OF INVENTION

An object of the present invention is to provide a mobile crane capable of solving the problems described above. A mobile crane to be provided includes: a crane main body including a lower traveling body capable of self-traveling on a traveling surface, and an upper swing body mounted on the lower traveling body to be capable of swinging around a swing center axis orthogonal to the traveling surface; a counterweight carrier capable of traveling following a movement of the crane main body, the counterweight carrier including a carrier main body on which a counterweight is loaded and a wheel unit attached to the carrier main body and including wheels capable of rolling on the traveling surface; a wheel driving device configured to rotate the wheels to thereby cause the counterweight carrier to travel, the wheel driving device being capable of changing a driving force for rotating the wheels; a loadage detector configured to detect a weight loadage index value, which is an index value of weight of the counterweight loaded on the carrier main body; and a controller configured to cause the wheel driving device to change the driving force of the wheel driving device for rotating the wheels such that the driving force increases as the weight loadage index value detected by the loadage detector increases.

DESCRIPTION OF EMBODIMENTS

A preferred embodiment of the present invention is explained with reference to the drawings.

Figure 1:
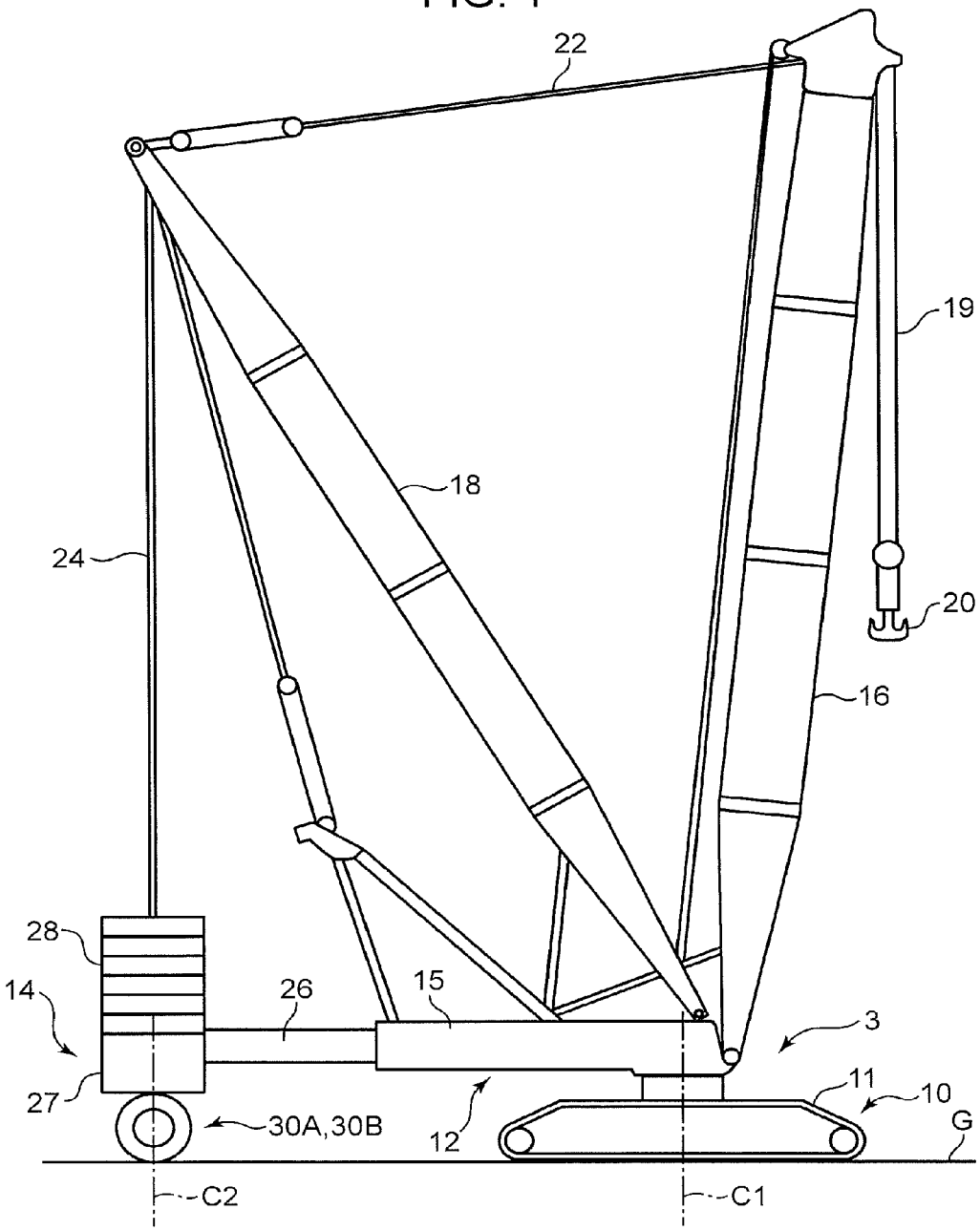
FIG. 1 is a side view of a mobile crane according to an embodiment of the present invention.

FIG. 1 shows a mobile crane according to an embodiment of the present invention. The mobile crane includes a crane main body 3, a counterweight carrier 14, and a coupling beam 26. The crane main body 3 includes a lower traveling body 10 and an upper swing body 12. The counterweight carrier 14 increases stability of the crane main body 3 and improves a hoisting ability of the crane main body 3. The counterweight carrier 14 is capable of traveling following a movement of the crane main body 3 in a state in which the counterweight carrier 14 is coupled to the crane main body 3.

Figure 2:
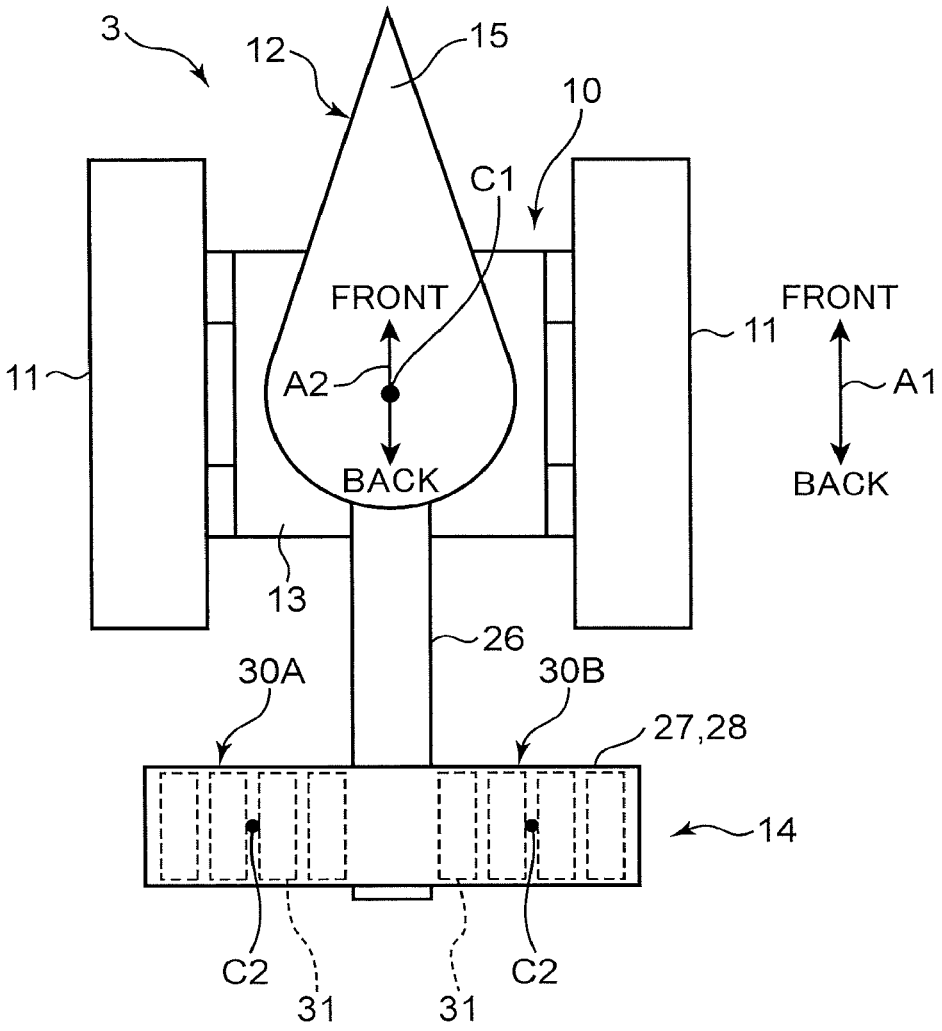
FIG. 2 is a plan view schematically showing a state in which a swing angle of an upper swing body with respect to a lower traveling body in the mobile crane is 0° and a counterweight carrier is in a translation traveling mode.

The lower traveling body 10 includes, as shown in FIG. 2, a traveling frame 13 and a pair of crawlers 11 respectively located on both outer sides in the left-right direction of the traveling frame 13, that is, the vehicle width direction. The lower traveling body 10 self-travels on a traveling surface G along the front-back direction of the lower traveling body 10 indicated by an arrow A1 in FIGS. 2 to 5 according to the operation of the crawlers 11. The front-back direction is a direction coinciding with the longitudinal direction of the crawlers 11 and is a direction orthogonal to the vehicle width direction.

The upper swing body 12 includes a swing frame 15, a boom 16, and a mast 18 shown in FIG. 1.

The swing frame 15 is mounted on the lower traveling body 10 to be capable of swinging around a swing center axis C1 orthogonal to the traveling surface G. In the swing frame 15, a front-back direction (the front-back direction of the upper swing body 12) independent from the front-back direction of the lower traveling body 10 is set as indicated by an arrow A2 in FIGS. 2 to 5.

The boom 16 (see FIG. 1) is attached to the front end portion of the swing frame 15 to be capable of performing a rising and falling motion by swinging around an axis for raising/lowering swing, the axis being parallel to the left-right direction (a direction orthogonal to the front-back direction) of the upper swing body 12. That is, the boom 16 includes a proximal end portion coupled to the front end portion of the swing frame 15 to be capable of swinging around the axis for raising/lowering swing and a distal end portion, which is an end portion on the opposite side of the proximal end portion. A hoisting accessory 20 is suspended from the distal end portion via a rope 19. A hoisting cargo is engaged with the hoisting accessory 20.

The mast 18 is a member for raising and lowering the boom 16. The mast 18 is raised and lowered by a not-shown mast raising/lowering device mounted on the upper swing body 12. The mast 18 raises and lowers the boom 16 to be associated with the raising and lowering of the mast 18. Specifically, the mast 18 includes a proximal end portion coupled to an intermediate part in the front-back direction of the swing frame 15 to be capable of swinging and a distal end portion on the opposite side of the proximal end portion. The distal end portion of the mast 18 is connected to the distal end portion of the boom 16 via a boom guyline 22. Therefore, the mast 18 is capable of supporting the boom 16 in an erected state from the back via the boom guyline 22.

The counterweight carrier 14 includes a carrier main body 27, a counterweight 28 mounted on the carrier main body 27, and a pair of wheel units 30A and 30B disposed on the lower side of the carrier main body 27. The counterweight carrier 14 is disposed in the backward direction the swing frame 15 in the upper swing body 12.

The carrier main body 27 is coupled to the distal end portion of the mast 18 via the carrier guyline 24 extending in the up-down direction shown in FIG. 1. The carrier main body 27 is coupled to the swing frame 15 via the coupling beam 26 extending from the rear end portion of the swing frame 15 in the backward direction of the swing frame 15. With these components, the counterweight carrier 14 balances a hoisting load applied to the front portion of the upper swing body 12 during hoisting work, a load of the boom 16, and the like and increases stability of the mobile crane to thereby improve a hoisting ability of the mobile crane.

Figure 6:
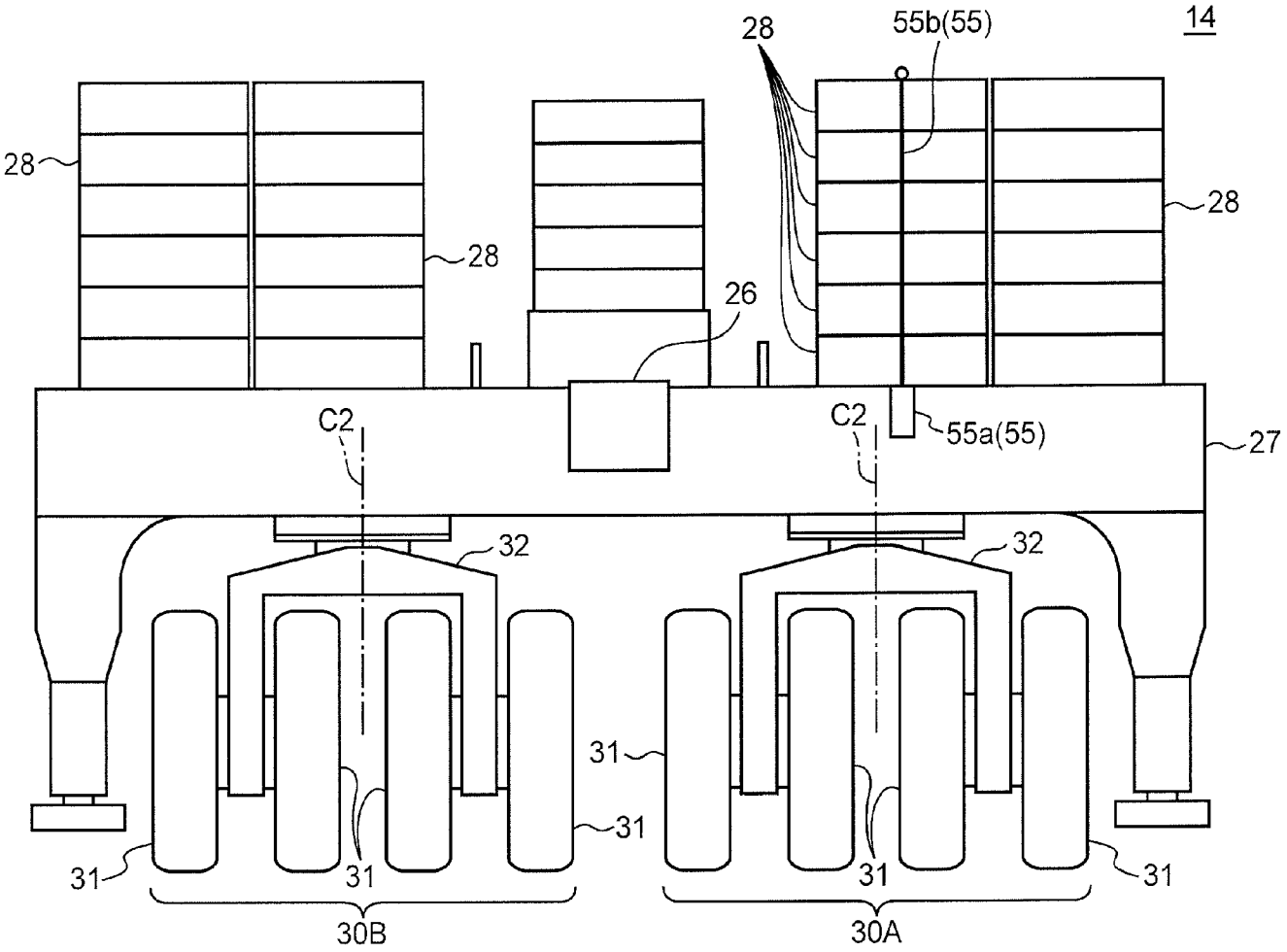
FIG. 6 is a view of the counterweight carrier viewed from the back.

The wheel units 30A and 30B include pluralities of wheels 31 facing the same direction with one another and wheel supporting frames 32 (see FIG. 6) that support the wheels 31. The wheel units 30A and 30B enable the counterweight carrier 14 to self-travel independently from the lower traveling body 10 according to rotation (rolling on the traveling surface G) around a rotation center axis parallel to the traveling surface G of the wheels 31.

Further, the wheel units 30A and 30B are attached to the carrier main body 27 to be capable of turning around steering axes C2 parallel to the swing center axis C1. The directions of the wheels 31 are collectively changed according to the turning around the steering axes C2 of the wheel units 30A and 30B. Consequently, the counterweight carrier 14 has a plurality of carrier traveling modes corresponding to different movements of the crane main body 3, a certain carrier traveling mode which corresponds to the movement of the crane main body 3 being selected from the plurality of carrier traveling modes.

Figure 3:
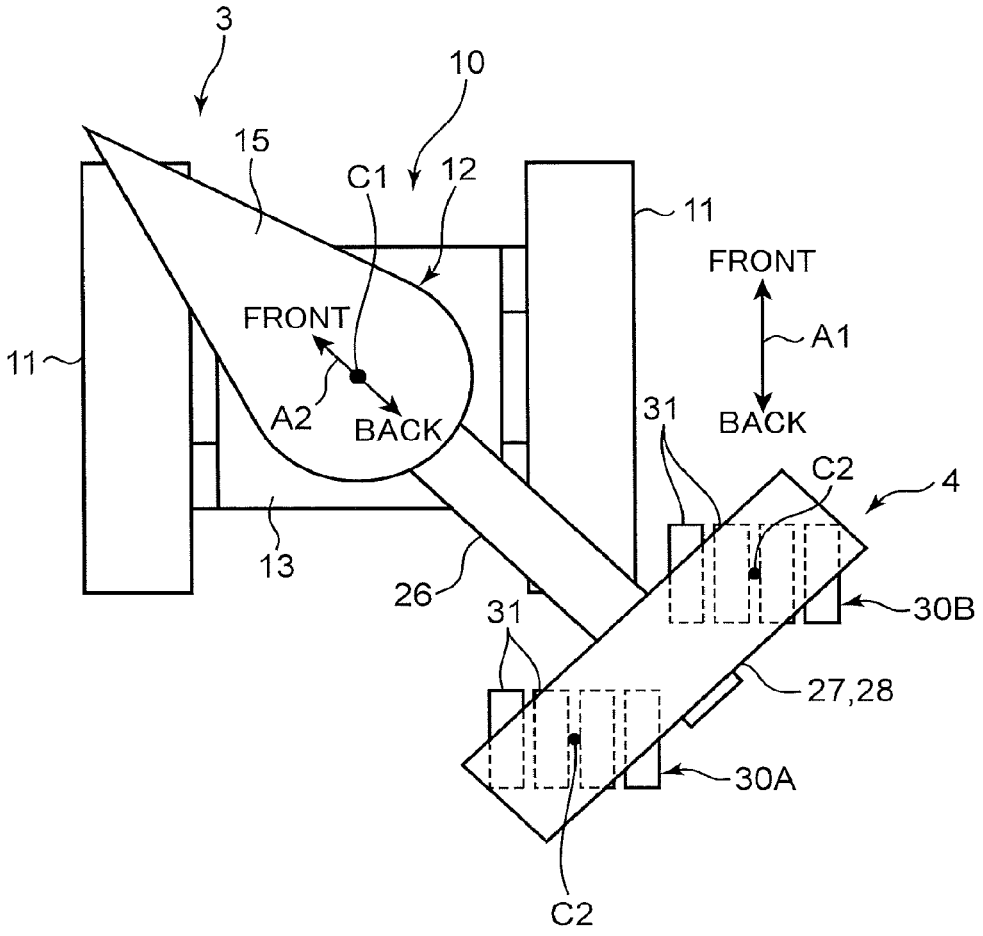
FIG. 3 is a plan view schematically showing a state in which the swing angle of the upper swing body with respect to the lower traveling body is 45° and the counterweight carrier is in the translation traveling mode.
Figure 4:
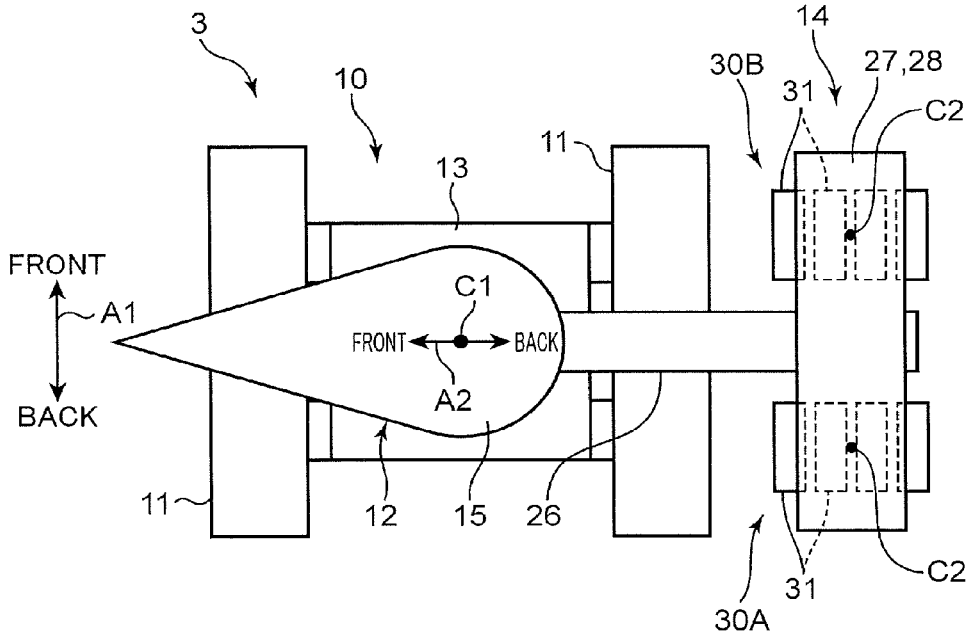
FIG. 4 is a plan view schematically showing a state in which the swing angle of the upper swing body with respect to the lower traveling body is 90° and the counterweight carrier is in the translation traveling mode.
Figure 5:
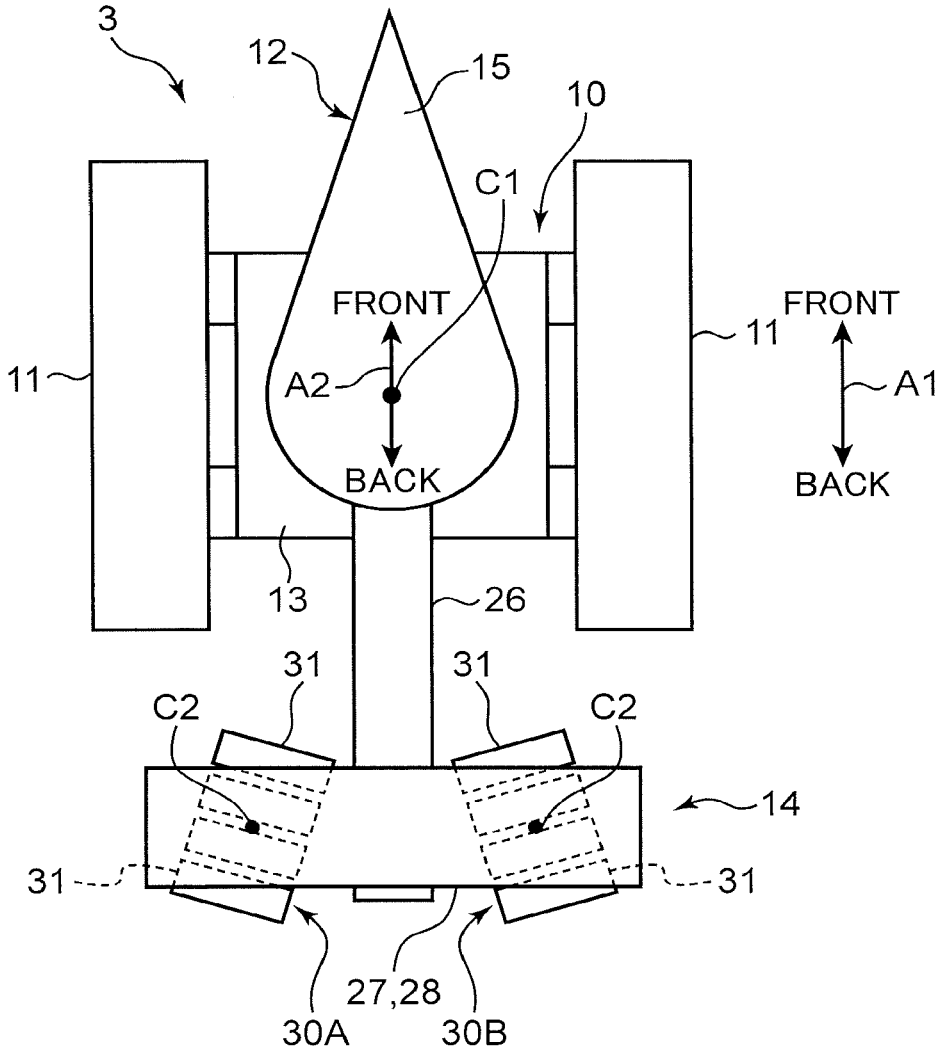
FIG. 5 is a plan view schematically showing a state in which the counterweight carrier is in a swing traveling mode.

In this embodiment, the plurality of carrier traveling modes include A) a swing traveling mode shown in FIG. 5 and B) a translation traveling mode shown in FIGS. 2 to 4.

A) The swing traveling mode is a mode in which the wheels 31 are rotated in a state in which the direction of the wheels 31 coincides with a swing direction of the upper swing body 12, whereby the counterweight carrier 14 travels in the swing direction of the upper swing body 12 following the swing of the upper swing body 12. That is, in the swing traveling mode, the counterweight carrier 14 travels along an arcuate track centering on the swing center axis C1 of the upper swing body 12.

B) The translation traveling mode is a mode in which the wheels 31 are rotated in a state in which a swing angle of the upper swing body 12 is any angle and the direction of the wheels 31 coincides with the front-back direction of the lower traveling body 10, whereby the counterweight carrier 14 travels following the traveling of the lower traveling body 10. That is, in the translation traveling mode, the counterweight carrier 14 travels to proceed in a direction same as the traveling direction of the lower traveling body 10, that is, to be translated with the lower traveling body 10.

Next, a driving control system mounted on the mobile crane is explained with reference to FIG. 7.

Figure 7:
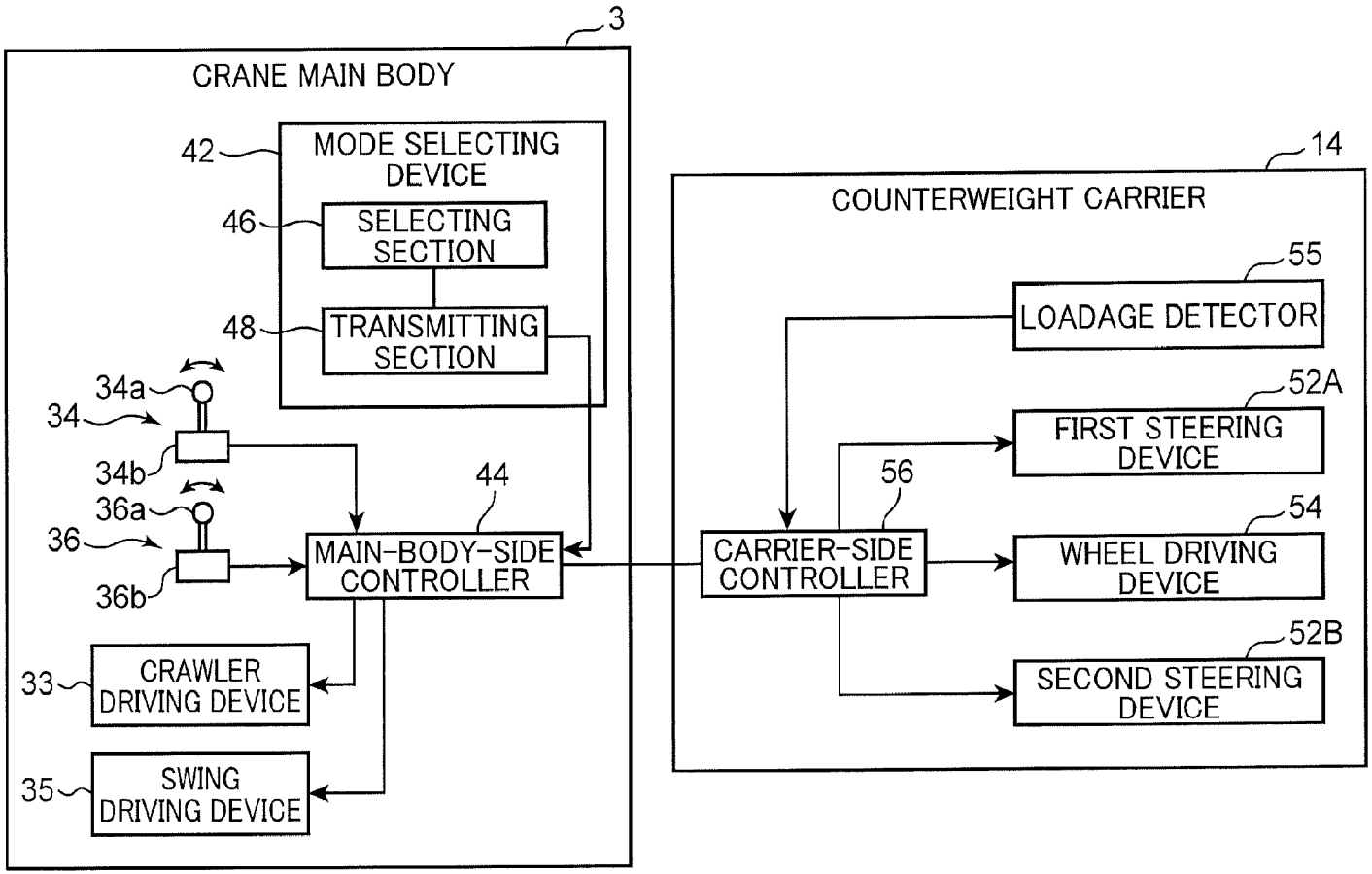
FIG. 7 is a block diagram showing a driving control system of the mobile crane.

A crawler driving device 33, a traveling operation device 34, a swing driving device 35, a swing operation device 36, a mode selecting device 42, a main-body-side controller 44 shown in FIG. 7 are mounted on the crane main body 3.

The crawler driving device 33 is a traveling driving device that causes the lower traveling body 10 to travel. The crawler driving device 33 drives the pair of crawlers 11 to thereby cause the lower traveling body 10 to self-travel.

The traveling operation device 34 is used to instruct traveling (forward movement or backward movement) and a traveling stop of the crane main body 3. The traveling operation device 34 is provided in a not-shown operator's cab included in the upper swing body 12. The traveling operation device 34 includes a traveling operation lever 34*a* and an operation device main body 34*b*. Turning operation for designating a traveling direction and traveling speed of the lower traveling body 10 is given to the traveling operation lever 34*a*. The operation device main body 34*b* generates a command signal concerning a traveling direction corresponding to a direction of operation given to the traveling operation lever 34*a* and traveling speed corresponding to an amount of the operation and inputs the generated command signal to the main-body-side controller 44.

The swing driving device 35 is a device that causes the upper swing body 12 to swing around the swing center axis C1.

The swing operation device 36 is used to instruct swing driving and a swing stop of the upper swing body 12. The swing operation device 36 is provided in the operator's cab. The swing operation device 36 includes a swing operation lever 36*a* and an operation device main body 36*b*. Turning operation for designating a swing direction and swing speed of the upper swing body 12 is given to the swing operation lever 36*a*. The operation device main body 36*b* generates a command signal concerning a swing direction corresponding to a direction of operation given to the swing operation lever 36*a* and swing speed corresponding to an amount of the operation and inputs the generated command signal to the main-body-side controller 44.

The mode selecting device 42 is used by an operator to select a desired carrier traveling mode out of the plurality of carrier traveling modes set as explained above concerning the traveling of the counterweight carrier 14. That is, the mode selecting device 42 is used by the operator to select a desired carrier traveling mode from the swing traveling mode and the translation traveling mode, that is, designate a carrier traveling mode that should be executed. Specifically, the mode selecting device 42 includes a selecting section 46 and a transmitting section 48. The selecting section 46 includes, for example, a plurality of selection buttons and receives operation performed by the operator to select the carrier traveling mode. The transmitting section 48 inputs, to the main-body-side controller 44, a mode selection signal for designating the carrier traveling mode selected by the operation of the selecting section 46.

The main-body-side controller 44 performs various kinds of control in the crane main body 3 on the basis of signals respectively input from the traveling operation device 34, the swing operation device 36, and the mode selecting device 42. Specifically, the main-body-side controller 44 performs control explained below.

1) Main-Body-Side Traveling Driving Control

The main-body-side controller 44 generates a traveling control signal on the basis of a command signal (a traveling command signal) input from the traveling operation device 34 and inputs the traveling control signal to the crawler driving device 33. Consequently, the main-body-side controller 44 causes the crawler driving device 33 to operate the crawlers 11 to cause the lower traveling body 10 to travel in a traveling direction corresponding to operation given to the traveling operation lever 34*a* of the traveling operation device 34 and at traveling speed corresponding to the operation.

2) Swing Driving Control

The main-body-side controller 44 generates a swing control signal on the basis of a command signal (a swing command signal) input from the swing operation device 36 and inputs the swing control signal to the swing driving device 35. Consequently, the main-body-side controller 44 causes the swing driving device 35 to operate to swing the upper swing body 12 in a swing direction corresponding to operation given to the swing operation lever 36*a* of the swing operation device 36 at swing speed corresponding to the operation.

3) Mode Switching Control

The main-body-side controller 44 inputs a mode command signal to a carrier-side controller 56 explained below to realize a carrier traveling mode selected by the operator using the mode selecting device 42. Specifically, the main-body-side controller 44 determines a selected carrier traveling mode on the basis of a mode selection signal input from the transmitting section 48 of the mode selecting device 42, generates a mode command signal concerning the determined carrier traveling mode, and inputs the mode command signal to the carrier-side controller 56.

The counterweight carrier 14 further includes, as the driving control system, as shown in FIG. 7, a first steering device 52A, a second steering device 52B, a wheel driving device 54, a loadage detector 55, and the carrier-side controller 56.

The first and second steering devices 52A and 52B are respectively annexed to the pair of wheel units 30A and 30B. The first and second steering device 52A or 52B turns the wheel units 30A or 30B corresponding thereto around the steering center axis C2 with respect to the carrier main body 27 and integrally steer the plurality of wheels 31 included in the wheel unit. The steering devices 52A and 52B include steering motors that turn the wheel units 30A and 30B and steering control circuits that receive a command signal input from the carrier-side controller 56 and control the operation of the steering motors.

The wheel driving device 54 is annexed to at least one of the first wheel unit 30A and the second wheel unit 30B. The wheel driving device 54 rotates the wheels 31 belonging to the wheel unit, to which the wheel driving device 54 is annexed, in a direction corresponding to a command signal input from the carrier-side controller 56 at speed corresponding to the command signal to thereby cause the counterweight carrier 14 to travel.

The wheel driving device 54 is capable of changing a driving force for rotating the wheels 31. Specifically, the wheel driving device 54 has a plurality of driving modes. A different driving force capable of rotating the wheels 31 set in each of the plurality of driving modes. More specifically, the wheel driving device 54 has a first driving mode in which a smallest driving force is set as the driving force capable of driving the wheels 31 among the plurality of driving modes, a second driving mode in which a larger driving force than the driving force set in the first driving mode is set as the driving force capable of driving the wheels 31, a third driving mode in which a larger driving force than the driving force set in the second driving mode is set as the driving force capable of driving the wheels 31, and a fourth driving mode in which a larger driving force than the driving force set in the third driving mode is set as the driving force capable of driving the wheels 31. The wheel driving device 54 has the first driving mode and the second driving mode as driving modes for the case of the selection of A) the swing traveling mode. The wheel driving device 54 includes the second driving mode, the third driving mode, and the fourth driving mode as driving modes for the case of the selection of B) the translation traveling mode.

Figure 8:
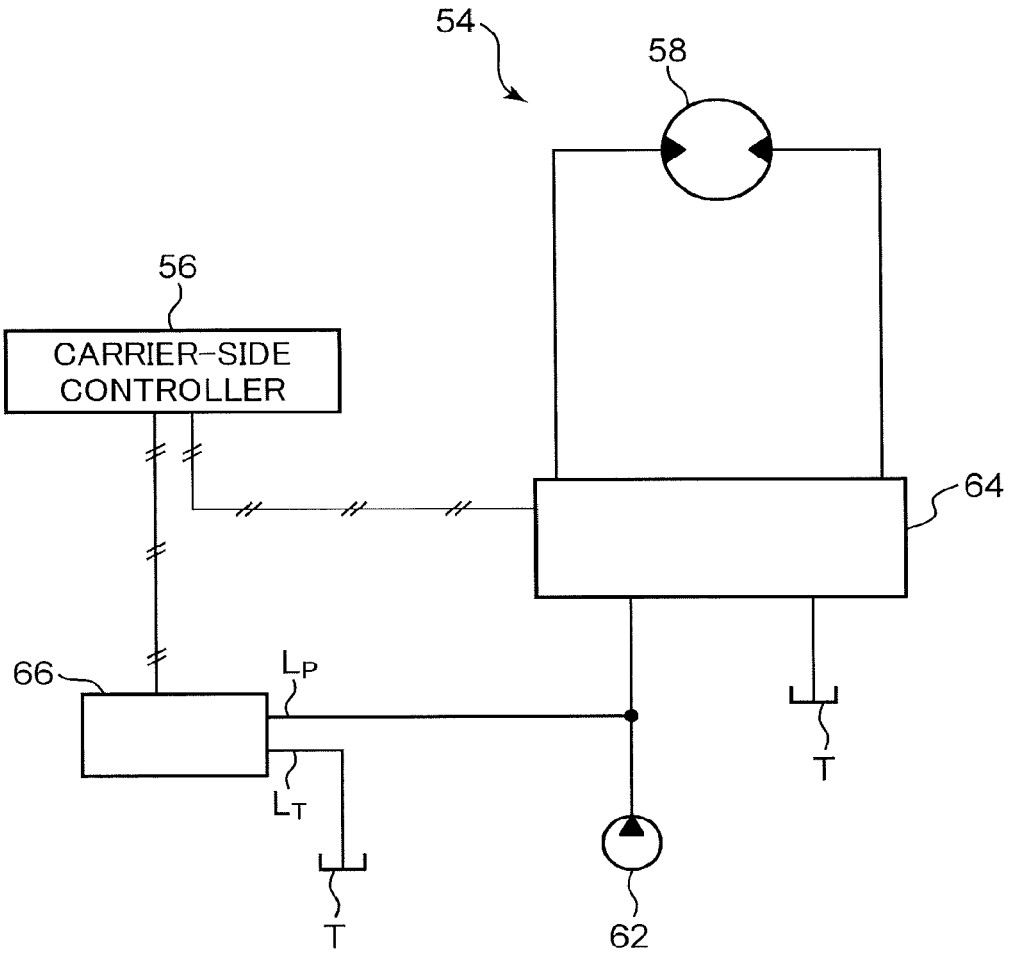
FIG. 8 is a hydraulic circuit diagram showing a wheel driving device of the counterweight carrier of the mobile crane.

The wheel driving device 54 includes, as shown in FIG. 8, a hydraulic motor 58, a hydraulic pump 62, a wheel-driving control circuit 64, and a relief circuit 66.

The hydraulic pump 62 discharges hydraulic oil supplied to the hydraulic motor 58. The hydraulic motor 58 operates to rotate the wheels 31 when the hydraulic oil discharged from the hydraulic pump 62 is supplied to the hydraulic motor 58. The hydraulic motor 58 rotates the wheels 31 with a driving force corresponding to the pressure of the supplied hydraulic oil, that is, a driving pressure. The hydraulic motor 58 includes a pair of ports and an output shaft coupled to the wheels 31. The hydraulic oil is supplied from the hydraulic pump 62 to any one of the ports of the hydraulic motor 58 through the wheel-driving control circuit 64, whereby the output shaft rotates in a direction corresponding to the port, to which the hydraulic oil is supplied, to thereby rotate the wheels 31 in the direction. At the same time, the hydraulic motor 58 discharges the hydraulic oil from the other port. The discharged hydraulic oil is returned to a tank T through the wheel-driving control circuit 64.

The wheel-driving control circuit 64 is interposed between the hydraulic motor 58 and the hydraulic pump 62. The wheel-driving control circuit 64 receives an input of a command signal from the carrier-side controller 56 and changes a direction of supply and a flow rate of the hydraulic oil from the hydraulic pump 62 to the hydraulic motor 58. The wheel-driving control circuit 64 includes, for example, a control valve configured from a pilot switching valve for switching an oil passage between the hydraulic pump 62 and the hydraulic motor 58, a pilot line for supplying a pilot pressure to the control valve, and an electromagnetic proportional decompression valve provided in the pilot line. The command signal from the carrier-side controller 56 is input to the electromagnetic proportional decompression valve, whereby the control of the supply direction and the supply flow rate of the hydraulic oil, that is, the control of the rotating direction and the rotating speed of the wheels 31 by the wheel-driving control circuit 64 is performed.

Figure 9:
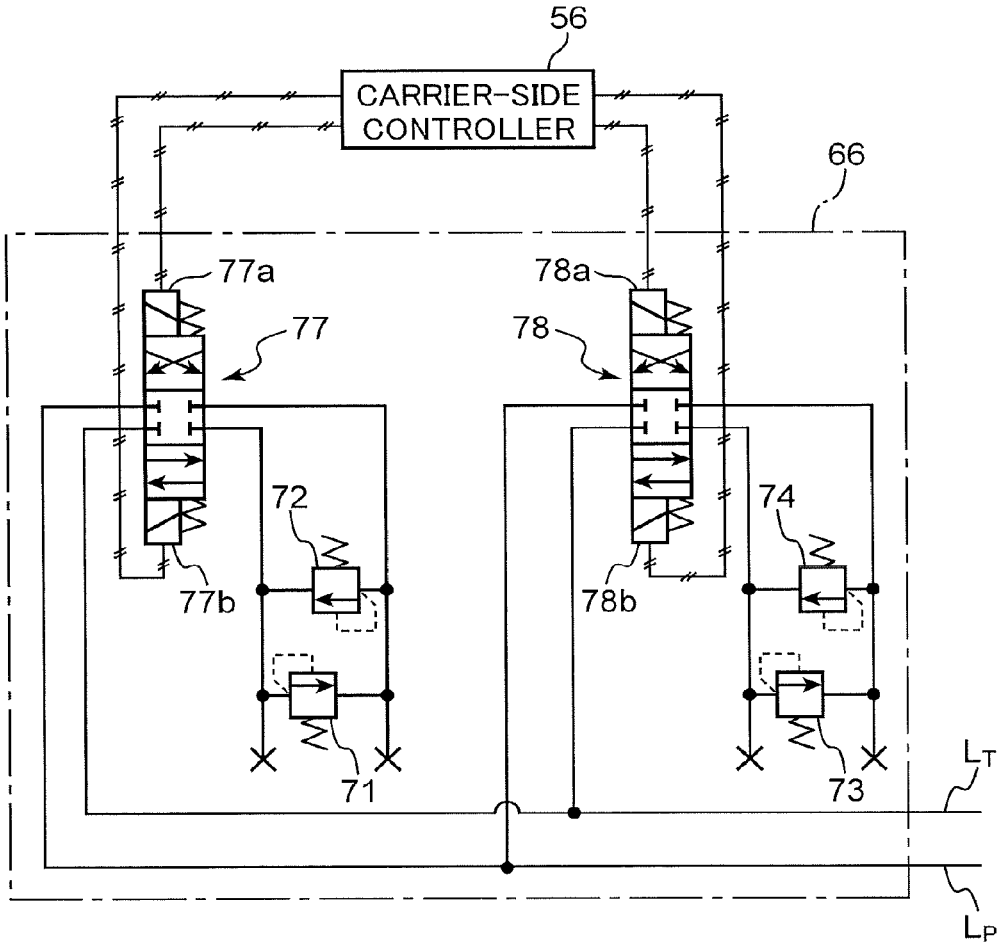
FIG. 9 is a hydraulic circuit diagram showing a relief circuit of the wheel driving device.

The relief circuit 66 is connected to an oil passage between the hydraulic pump 62 and the wheel-driving control circuit 64. The relief circuit 66 allows a part of the hydraulic oil discharged from the hydraulic pump 62 to escape to the tank T without supplying the part of the hydraulic oil to the hydraulic motor 58. The relief circuit 66 includes a first relief valve 71, a second relief valve 72, a third relief valve 73, a fourth relief valve 74, a low-pressure-side relief selection valve 77, and a high-pressure-side relief selection valve 78 shown in FIG. 9.

The first to fourth relief valves 71 to 74 have set pressures different from one another. Specifically, the first relief valve 71 has a first set pressure P1. The second relief valve 72 has a second set pressure P2 higher than the first set pressure P1. The third relief valve 73 has a third set pressure P3 higher than the second set pressure P2. The fourth relief valve 74 has a fourth set pressure P4 higher than the third set pressure P3. The relief valves 71 to 74 are provided across a pump line $L_P$ connected to an oil passage between the hydraulic pump 62 and the control valve of the wheel-driving control circuit 64 and a tank line $L_T$ connected to the tank T and are provided in parallel to each other.

The low-pressure-side relief selection valve 77 is an electromagnetic switching valve. The low-pressure-side relief selection valve 77 selectively enables one of the first relief valve 71 and the second relief valve 72 according to a command signal input to the low-pressure-side relief selection valve 77 from the carrier-side controller 56 to thereby allow the hydraulic oil to escape from the pump line $L_P$ to the tank line $L_T$ through the enabled relief valve.

Specifically, the low-pressure-side relief selection valve 77 includes one solenoid 77*a* and the other solenoid 77*b*. The low-pressure-side relief selection valve 77 enables the first relief valve 71 by setting a state in which the pump line $L_P$ is connected to a primary side of the first relief valve 71 and a secondary side of the first relief valve 71 is connected to the tank line $L_T$ according to an input of a command signal to the one solenoid 77*a*. The low-pressure-side relief selection valve 77 enables the second relief valve 72 by setting a state in which the pump line $L_P$ is connected to a primary side of the second relief valve 72 and a secondary side of the second relief valve 72 is connected to the tank line $L_T$ according to an input of a command signal to the other solenoid 77*b*.

Note that, in the state in which the pump line $L_P$ is connected to the primary side of the first relief valve 71 and the secondary side of the first relief valve 71 is connected to the tank line $L_T$, the secondary side of the second relief valve 72 is connected to the pump line $L_P$ and the primary side of the second relief valve 72 is connected to the tank line $L_T$. However, in this state, the second relief valve 72 is not enabled and the hydraulic oil does not flow through the second relief valve 72. In the state in which the pump line $L_P$ is connected to the primary side of the second relief valve 72 and the secondary side of the second relief valve 72 is connected to the tank line $L_T$, the secondary side of the first relief valve 71 is connected to the pump line $L_P$ and the primary side of the first relief valve 71 is connected to the tank line $L_T$. However, in this state, the first relief valve 71 is not enabled and the hydraulic oil does not flow through the first relief valve 71.

The high-pressure-side relief selection valve 78 is an electromagnetic switching valve. The high-pressure-side relief selection valve 78 selectively enables one of the third relief valve 73 and the fourth relief valve 74 according to a command signal input to the high-pressure-side relief selection valve 78 from the carrier-side controller 56 to thereby allow the hydraulic oil to escape from the pump line $L_P$ to the tank line $L_T$ through the enabled relief valve.

Specifically, the high-pressure-side relief selection valve 78 includes one solenoid 78*a* and the other solenoid 78*b*. The high-pressure-side relief selection valve 78 enables the third relief valve 73 by setting a state in which the pump line $L_P$ is connected to a primary side of the third relief valve 73 and a secondary side of the third relief valve 73 is connected to the tank line $L_T$ according to an input of a command signal to the one solenoid 78*a*. The high-pressure-side relief selection valve 78 enables the fourth relief valve 74 by setting a state in which the pump line $L_P$ is connected to a primary side of the fourth relief valve 74 and a secondary side of the fourth relief valve 74 is connected to the tank line $L_T$ according to an input of a command signal to the other solenoid 78*b*.

Note that, in the state in which the pump line $L_P$ is connected to the primary side of the third relief valve 73 and the secondary side of the third relief valve 73 is connected to the tank line $L_T$, the secondary side of the fourth relief valve 74 is connected to the pump line $L_P$ and the primary side of the fourth relief valve 74 is connected to the tank line $L_T$. However, in this state, the fourth relief valve 74 is not enabled and the hydraulic oil does not flow through the fourth relief valve 74. In the state in which the pump line $L_P$ is connected to the primary side of the fourth relief valve 74 and the secondary side of the fourth relief valve 74 is connected to the tank line $L_T$, the secondary side of the third relief valve 73 is connected to the pump line $L_P$ and the primary side of the third relief valve 73 is connected to the tank line $L_T$. However, in this state, the third relief valve 73 is not enabled and the hydraulic oil does not flow through the third relief valve 73.

Any one of the first to fourth relief valves 71 to 74 is enabled, whereby the pressure of the hydraulic oil supplied to the hydraulic motor 58, that is, a driving pressure of the hydraulic motor 58 changes to a set pressure of the enabled relief valve. The hydraulic motor 58 generates a driving force corresponding to the driving pressure thereof. Therefore, when the second relief valve 72 is enabled, the hydraulic motor 58 generates a driving force larger than a driving force generated when the first relief valve 71 is enabled. When the third relief valve 73 is enabled, the hydraulic motor 58 generates a driving force larger than the driving force generated when the second relief valve 72 is enabled. When the fourth relief valve 74 is enabled, the hydraulic motor 58 generates a driving force larger than the driving force generated when the third relief valve 73 is enabled. Therefore, a state in which the first relief valve 71 is enabled is equivalent to the first driving mode of the wheel driving device 54. A state in which the second relief valve 72 is enabled is equivalent to the second driving mode of the wheel driving device 54. A state in which the third relief valve 73 is enabled is equivalent to the third driving mode of the wheel driving device 54. A state in which the fourth relief valve 74 is enabled is equivalent to the fourth driving mode of the wheel driving device 54.

The loadage detector 55 detects a weight loadage index value, which is an index value of the weight of the counterweight 28 loaded on the carrier main body 27, generates a detection signal corresponding to the detected weight loadage index value, and inputs the detection signal to the carrier-side controller 56.

Specifically, in this embodiment, the loadage detector 55 is a so-called stroke meter. The loadage detector 55 measures, as the weight loadage index value, a distance in a direction along the steering axis C2 from the carrier main body 27 to a top position of the counterweight 28 loaded on the carrier main body 27. The distance from the carrier main body 27 to the top position corresponds to the number of loading stages of the counterweight 28 on the carrier main body 27. Therefore, the distance is a value corresponding to the weight of the counterweight 28 loaded on the carrier main body 27, that is, the weight loadage index value.

More specifically, the loadage detector 55 includes a detector main body 55*a* attached to the carrier main body 27 and a detection wire 55*b* capable of being drawn out from the detector main body 55*a*. The detection wire 55*b* is drawn out upward from the detector main body 55*a* along the steering axis C2 by the operator, a worker, or the like. The distal end of the detection wire 55*b* is locked to the top portion of the counterweight 28 at the top stage. The detector main body 55*a* measures, as the distance from the carrier main body 27 to the top position, the length of the detection wire 55*b* drawn out from the detector main body 55*a*, that is, the drawn-out length of the detection wire 55*b* and generates, as the detection signal, an electric signal having a voltage corresponding to the measured drawn-out length. That is, the detector main body 55*a* generates a detection signal having a larger voltage as the drawn-out length of the detection wire 55*b* increases. Therefore, the distance from the carrier main body 27 to the top position serving as the weight loadage index value detected by the loadage detector 55 is actually represented by a voltage value of the detection signal generated by the loadage detector 55.

The carrier-side controller 56 is an example of the controller in the present invention. The carrier-side controller 56 controls, on the basis of a mode command signal input from the main-body-side controller 44, that is, on the basis of a carrier traveling mode selected using the mode selecting device 42, the operations of the steering devices 52A and 52B and the wheel driving device 54 to realize the selected carrier traveling mode. Consequently, the carrier-side controller 56 causes the counterweight carrier 14 to travel following the movement of the crane main body 3.

Specifically, when A) the swing traveling mode is selected, the carrier-side controller 56 causes the first and second steering devices 52A and 52B to operate to match the direction of the wheels 31 of the wheel units 30A and 30B with the swing direction of the upper swing body 12. The carrier-side controller 56 causes the wheel driving device 54 to operate to cause the counterweight carrier 14 to swing and travel at swing angular velocity equal to swing angular velocity of the upper swing body 12.

When B) the translation traveling mode is selected, the carrier-side controller 56 causes the first and second steering devices 52A and 52B to operate to match the direction of the wheels 31 of the wheel units 30A and 30B with the front-back direction of the lower traveling body 10. The carrier-side controller 56 causes the wheel driving device 54 to operate to cause the counterweight carrier 14 to travel at speed equal to the traveling speed of the lower traveling body 10.

The carrier-side controller 56 causes, on the basis of the detection signal input from the detector main body 55*a* of the loadage detector 55, that is, on the basis of the weight loadage index value detected by the loadage detector 55, the wheel driving device 54 to change a driving force of the hydraulic motor 58, which rotates the wheels 31, such that the driving force increases as the weight loadage index value increases.

Specifically, a correlation between a voltage value of the detection signal and the number of loading stages of the counterweight 28 is incorporated in the carrier-side controller 56 in advance. The carrier-side controller 56 derives, on the basis of the incorporated correlation, as the weight loadage index value, the number of loading stages of the counterweight 28 corresponding to a voltage value of the detection signal input from the detector main body 55*a*. The carrier-side controller 56 has a plurality of segments for classifying numbers of loading stages of the counterweight 28. The plurality of segments include, for example, a first segment serving as a segment with a small number of loading stages, a second segment serving as a segment with the number of loading stages larger than the number of loading stages of the first segment, and a third segment serving as a segment with the number of loading stages larger than the number of loading stages of the second segment. The carrier-side controller 56 specifies, among the first to third segments, a segment corresponding to the number of loading stages derived as explained above.

When A) the swing traveling mode is selected, the carrier-side controller 56 selects the first driving mode with the small driving force as the driving mode of the wheel driving device 54 when the number of loading stages of the counterweight 28 derived from the voltage value of the detection signal corresponds to the first segment or the second segment. When A) the swing traveling mode is selected, the carrier-side controller 56 selects the second driving mode with the driving force larger than the driving force of the first driving mode as the driving mode of the wheel driving device 54 when the number of loading stages of the counterweight 28 derived from the voltage value of the detection signal corresponds to the third segment.

When B) the translation traveling mode is selected, the carrier-side controller 56 selects the second driving mode as the driving mode of the wheel driving device 54 when the number of loading stages of the counterweight 28 derived from the voltage value of the detection signal corresponds to the first segment. When B) the translation traveling mode is selected, the carrier-side controller 56 selects the third driving mode with the driving force larger than the driving force of the second driving mode as the driving mode of the wheel driving device 54 when the number of loading stages of the counterweight 28 derived from the voltage value of the detection signal corresponds to the second segment. When B) the translation traveling mode is selected, the carrier-side controller 56 selects the fourth driving mode with the driving force larger than the driving force of the third driving mode as the driving mode of the wheel driving device 54 when the number of loading stages of the counterweight 28 derived from the voltage value of the detection signal corresponds to the third segment.

Therefore, when the selected carrier traveling mode is the swing traveling mode and a certain number of loading stages of the counterweight 28 is derived from the voltage value of the detection signal, the carrier-side controller 56 causes the wheel driving device 54 to rotate the wheels 31 with a first driving force, and when the selected carrier traveling mode is the translation traveling mode and a number of loading stages of the counterweight 28 same as the certain number is derived from the voltage value of the detection signal, the carrier-side controller 56 causes the wheel driving device 54 to rotate the wheels 31 with a second driving force larger than the first driving force. That is, when the number of loading stages of the counterweight 28 derived from the voltage value of the detection signal is the same, the carrier-side controller 56 selects, as the driving mode of the wheel driving device 54, a driving mode for rotating the wheels 31 with larger driving force when the translation traveling mode is selected than when the swing traveling mode is selected. The selection of the driving mode by the carrier-side controller 56 is specifically performed as explained below.

When A) the swing traveling mode is selected or B) the translation traveling mode is selected, the carrier-side controller 56 causes the low-pressure-side relief selection valve 77 or the high-pressure-side relief selection valve 78 to operate to select, out of the first to fourth relief valves 71 to 74 of the relief circuit 66, one relief valve having a set pressure corresponding to the segment of the number of loading stages of the counterweight 28 specified as explained above and enable the relief valve. Consequently, the carrier-side controller 56 selects a driving mode corresponding to the specified segment of the number of loading stages of the counterweight 28.

When A) the swing traveling mode is selected, the carrier-side controller 56 selects the first driving mode by inputting a command signal to the one solenoid 77*a* of the low-pressure-side relief selection valve 77 and causing the low-pressure-side relief selection valve 77 to selectively enable the first relief valve 71 when the specified segment of the number of loading stages of the counterweight 28 is the first segment or the second segment. When A) the swing traveling mode is selected, the carrier-side controller 56 selects the second driving mode by inputting a command signal to the other solenoid 77*b* of the low-pressure-side relief selection valve 77 and causing the low-pressure-side relief selection valve 77 to selectively enable the second relief valve 72 when the specified segment of the number of loading stages of the counterweight 28 is the third segment.

When B) the translation traveling mode is selected, the carrier-side controller 56 selects the second driving mode by inputting a command signal to the other solenoid 77*b* of the low-pressure-side relief selection valve 77 and causing the low-pressure-side relief selection valve 77 to selectively enable the second relief valve 72 when the specified segment of the number of loading stages of the counterweight 28 is the first segment. When B) the translation traveling mode is selected, the carrier-side controller 56 selects the third driving mode by inputting a command signal to the one solenoid 78*a* of the high-pressure-side relief selection valve 78 and causing the high-pressure-side relief selection valve 78 to selectively enable the third relief valve 73 when the specified segment of the number of loading stages of the counterweight 28 is the second segment. When B) the translation traveling mode is selected, the carrier-side controller 56 selects the fourth driving mode by inputting a command signal to the other solenoid 78*b* of the high-pressure-side relief selection valve 78 and causing the high-pressure-side relief selection valve 78 to selectively enable the fourth relief valve 74 when the specified segment of the number of loading stages of the counterweight 28 is the third segment.

Figure 10:
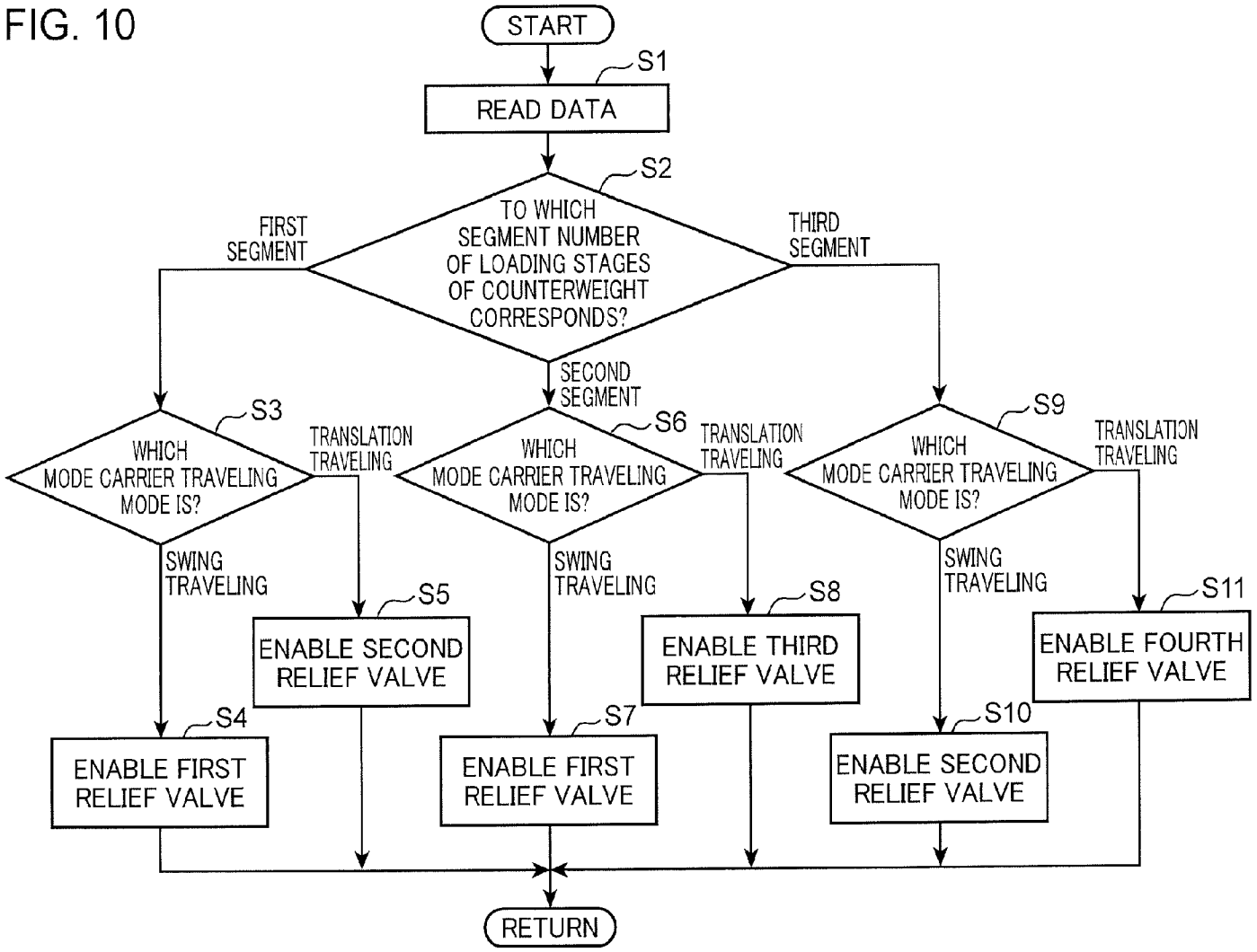
FIG. 10 is a flowchart for explaining a setting process for a driving pressure of a hydraulic motor for selecting a driving mode of the wheel driving device.

In FIG. 10, a control process is shown in which the carrier-side controller 56 selectively enables one relief valve among the first to fourth relief valves 71 to 74 and sets a driving pressure of the hydraulic motor 58 to thereby select a driving mode of the wheel driving device 54. The control process is explained with reference to the flowchart of FIG. 10.

First, the carrier-side controller 56 reads data indicating a carrier traveling mode selected using the mode selecting device 42 and data of the weight loadage index value (step S1). Specifically, the carrier-side controller 56 reads, as the data indicating the selected carrier traveling mode, a carrier traveling mode designated by the mode command signal input to the carrier-side controller 56 from the main-body-side controller 44. The carrier-side controller 56 reads, as the data of the weight loadage index value, a voltage value of the detection signal input to the carrier-side controller 56 from the loadage detector 55.

Subsequently, the carrier-side controller 56 determines to which segment among the first to third segments the number of loading stages of the counterweight 28 derived from the read voltage value of the detection signal corresponds. Specifically, the carrier-side controller 56 derives, on the basis of the correspondence relation between the voltage value of the detection signal and the number of loading stages of the counterweight 28 incorporated in the carrier-side controller 56, the number of loading stages of the counterweight 28 corresponding to the voltage value of the detection signal read in step S1 and determines to which segment among the first to third segments the derived number of loading stages corresponds. Note that the voltage value of the detection signal sometimes includes an error because of various factors. In such a case, the carrier-side controller 56 does not perform the derivation of the number of loading stages of the counterweight 28 and the determination and emits, for example, with a not-shown warming device, a warning for notifying that a detection error has occurred in the loadage detector 55.

When determining that the number of loading stages of the counterweight 28 corresponds to the first segment, subsequently, the carrier-side controller 56 determines which mode the carrier traveling mode read in step S1, that is, the carrier traveling mode selected using the mode selecting device 42 is (step S3). Specifically, the carrier-side controller 56 determines which mode of the swing traveling mode and the translation traveling mode the carrier traveling mode read in step S1 is.

When determining that the read carrier traveling mode is the swing traveling mode, the carrier-side controller 56 inputs a command signal to the one solenoid 77*a* of the low-pressure-side relief selection valve 77 of the relief circuit 66 and causes the low-pressure-side relief selection valve 77 to enable the first relief valve 71 (step S4). At this point, the second relief valve 72 is not enabled. Further, the carrier-side controller 56 does not input a command signal to the high-pressure-side relief selection valve 78 at this point. Therefore, the high-pressure-side relief selection valve 78 does not enable both of the third relief valve 73 and the fourth relief valve 74.

The first relief valve 71 among the first to fourth relief valves 71 to 74 is selectively enabled in this way, whereby the relief circuit 66 allows a part of the hydraulic oil discharged from the hydraulic pump 62 to escape from the pump line $L_P$ to the tank T through the first relief valve 71. At this point, the pressure of the hydraulic oil supplied to the hydraulic motor 58, that is, the driving pressure of the hydraulic motor 58 is the first set pressure P1 of the first relief valve 71.

On the other hand, when determining in step S3 that the carrier traveling mode read in step S1 is the translation traveling mode, the carrier-side controller 56 inputs a command signal to the other solenoid 77*b* of the low-pressure-side relief selection valve 77 and causes the low-pressure-side relief selection valve 77 to enable the second relief valve 72 (step S5). At this point, the first relief valve 71 is not enabled. Further, the carrier-side controller 56 does not input a command signal to the high-pressure-side relief selection valve 78 at this point. Therefore, the high-pressure-side relief selection valve 78 does not enable both of the third relief valve 73 and the fourth relief valve 74.

The second relief valve 72 among the first to fourth relief valves 71 to 74 is selectively enabled in this way, whereby the relief circuit 66 allows a part of the hydraulic oil discharged from the hydraulic pump 62 to escape from the pump line $L_P$ to the tank T through the second relief valve 72. At this point, the pressure of the hydraulic oil supplied to the hydraulic motor 58, that is, the driving pressure of the hydraulic motor 58 is the second set pressure P2 of the second relief valve 72.

When determining in step S2 that the number of loading stages of the counterweight 28 corresponds to the second segment, subsequently, the carrier-side controller 56 performs determination of the carrier traveling mode same as the determination in step S3 (step S6). When determining that the carrier traveling mode read in step S1 is the swing traveling mode, the carrier-side controller 56 selectively enables the first relief valve 71 among the first to fourth relief valves 71 to 74 as in step S4 (step S7). In this case, the driving pressure of the hydraulic motor 58 is the first set pressure P1 of the first relief valve 71 as in step S4.

On the other hand, when determining in step S6 that the carrier traveling mode read in step S1 is the translation traveling mode, the carrier-side controller 56 inputs a command signal to the one solenoid 78*a* of the high-pressure-side relief selection valve 78 and causes the high-pressure-side relief selection valve 78 to enable the third relief valve 73 (step S8). At this point, the fourth relief valve 74 is not enabled. Further, the carrier-side controller 56 does not input a command signal to the low-pressure-side relief selection valve 77 at this point. Therefore, the low-pressure-side relief selection valve 77 does not enable both of the first relief valve 71 and the second relief valve 72.

The third relief valve 73 among the first to fourth relief valves 71 to 74 is selectively enabled in this way, whereby the relief circuit 66 allows a part of the hydraulic oil discharged from the hydraulic pump 62 to escape from the pump line $L_P$ to the tank T through the third relief valve 73. At this point, the pressure of the hydraulic oil supplied to the hydraulic motor 58, that is, the driving pressure of the hydraulic motor 58 is the third set voltage P3 of the third relief valve 73.

When determining in step S2 that the number of loading stages of the counterweight 28 corresponds to the third segment, subsequently, the carrier-side controller 56 performs determination of the carrier traveling mode same as the determination in step S3 (step S9). When determining that the carrier traveling mode read in step S1 is the swing traveling mode, the carrier-side controller 56 selectively enables the second relief valve 72 among the first to fourth relief valves 71 to 74 as in step S5 (step S10). In this case, the driving pressure of the hydraulic motor 58 is the second set pressure P2 of the second relief valve 72 as in step S5.

On the other hand, when determining in step S9 that the carrier traveling mode read in step S1 is the translation traveling mode, the carrier-side controller 56 inputs a command signal to the other solenoid 78*b* of the high-pressure-side relief selection valve 78 and causes the high-pressure-side relief selection valve 78 to enable the fourth relief valve 74 (step S11). At this point, the third relief valve 73 is not enabled. Further, the carrier-side controller 56 does not input a command signal to the low-pressure-side relief selection valve 77 at this point. Therefore, the low-pressure-side relief selection valve 77 does not enable both of the first relief valve 71 and the second relief valve 72.

The fourth relief valve 74 among the first to fourth relief valves 71 to 74 is selectively enabled in this way, whereby the relief circuit 66 allows a part of the hydraulic oil discharged from the hydraulic pump 62 to escape from the pump line $L_P$ to the tank T through the fourth relief valve 74. At this point, the pressure of the hydraulic oil supplied to the hydraulic motor 58, that is, the driving pressure of the hydraulic motor 58 is the fourth set voltage P4 of the fourth relief valve 74.

As explained above, the driving pressure of the hydraulic motor 58 is set according to the selected carrier traveling mode and the number of loading stages of the counterweight 28 corresponding to the counterweight loadage. The hydraulic motor 58 is driven with the set driving pressure. Consequently, the hydraulic motor 58 drives the wheels 31 with a driving force corresponding to the set driving pressure, that is, a driving force corresponding to the selected carrier traveling mode and the counterweight loadage and causes the counterweight carrier 14 to travel.

In this embodiment, the carrier-side controller 56 changes the driving force for rotating the wheels 31 of the counterweight carrier 14 according to the number of loading stages of the counterweight 28 corresponding to the counterweight loadage of the counterweight carrier 14. Therefore, it is possible to drive the counterweight carrier 14 to travel with a proper driving force irrespective of the counterweight loadage. Specifically, when the counterweight loadage is large, by increasing the driving force according to the counterweight loadage, it is possible to cause the counterweight carrier 14 to travel with a sufficient driving force irrespective of the large counterweight loadage. On the other hand, when the counterweight loadage is small, by reducing the driving force according to the counterweight loadage, it is possible to reduce a loss of energy for the driving of the counterweight carrier 14. Further, it is possible to prevent synchronization of the crane main body 3 and the counterweight carrier 14 from being hindered by an excessively large driving force.

In this embodiment, as the voltage value of the detection signal of the loadage detector 55 increases, that is, as the number of loading stages of the counterweight 28 corresponding to the voltage value of the detection signal increases, the carrier-side controller 56 selects a driving mode capable of rotating the wheels 31 with a larger driving force among the plurality of driving modes of the wheel driving device 54 and causes the wheel driving device 54 to rotate the wheels 31 in the selected driving mode. That is, in this embodiment, with a simple control operation of selecting an appropriate driving mode out of the plurality of driving modes, it is possible to cause the counterweight carrier 14 to travel with a driving force corresponding to the counterweight loadage.

In this embodiment, the carrier-side controller 56 causes the low-pressure-side relief selection valve 77 or the high-pressure-side relief selection valve 78 to operate to select one relief valve corresponding to the number of loading stages of the counterweight 28 among the first to fourth relief valves 71 to 74 of the relief circuit 66 and enable the relief valve. Therefore, it is possible to realize, with simple control, driving of the counterweight carrier 14 with a relief pressure corresponding to counterweight loadage, that is, a driving pressure corresponding to counterweight loadage.

However, the mobile crane according to the present invention is not limited to the mobile crane disclosed in FIGS. 1 to 10. The present invention can take, for example, forms explained below.

Figure 11:
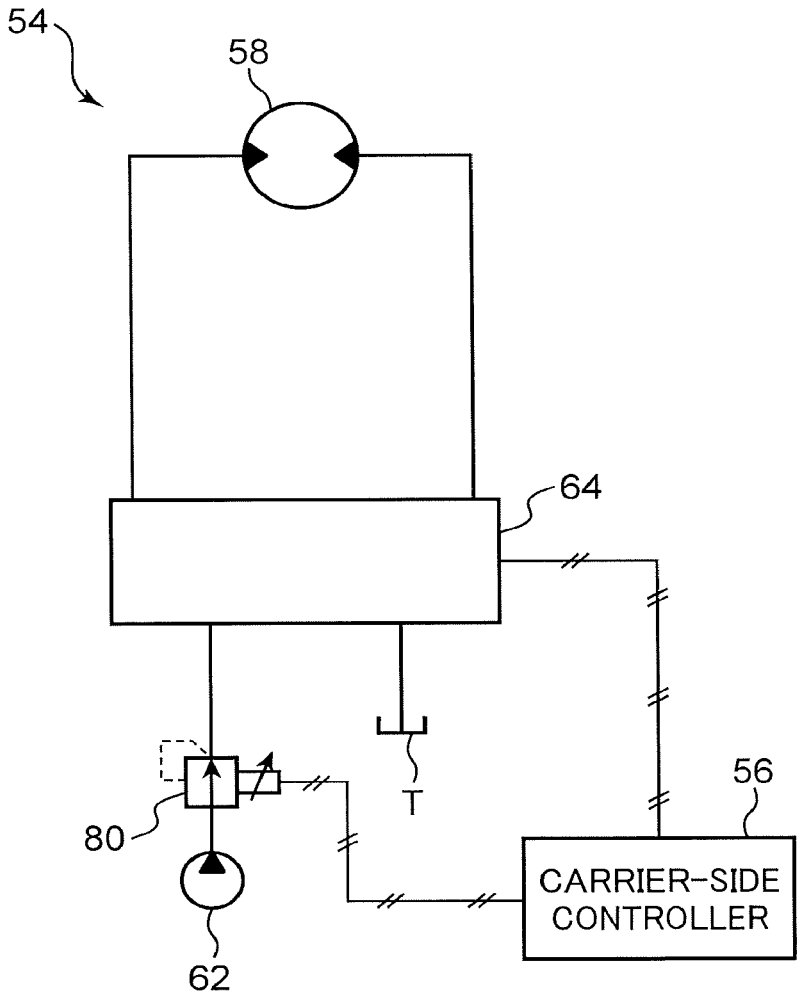
FIG. 11 is a hydraulic circuit diagram showing a wheel driving device of a counterweight carrier of a mobile crane according to a modification of the present invention.

As means for changing the driving force of the hydraulic motor 58 for rotating the wheels 31, that is, means for changing the driving pressure of the hydraulic motor 58, the wheel driving device 54 may include an electromagnetic proportional decompression valve 80 shown in FIG. 11 instead of the relief circuit 66. The electromagnetic proportional decompression valve 80 is provided in the oil passage between the hydraulic pump 62 and the control valve of the wheel-driving control circuit 64. The electromagnetic proportional decompression valve 80 reduces the hydraulic pressure of the hydraulic oil discharged from the hydraulic pump 62 and supplied to the hydraulic motor 58 side. In this form, the carrier-side controller 56 only has to cause the electromagnetic proportional decompression valve 80 to adjust the hydraulic pressure supplied to the hydraulic motor 58 side such that the hydraulic pressure supplied to the hydraulic motor 58 increases as a value detected by the loadage detector 55 increases. Specifically, the carrier-side controller 56 only has to generate an electric current corresponding to the weight loadage index value (the voltage value of the detection signal) detected by the loadage detector 55 (see FIG. 7) and input the generated electric current to the electromagnetic proportional decompression valve 80 to thereby cause the electromagnetic proportional decompression valve 80 to adjust the hydraulic pressure supplied to the hydraulic motor 58 side. In this case, it is possible to freely change the driving pressure of the hydraulic motor 58, that is, the driving force of the hydraulic motor 58 according to the weight loadage index value detected by the loadage detector 55.

As the loadage detector that detects the weight loadage index value, a loadage detector other than the stroke meter explained above may be used. For example, a load meter that measures a total weight of the counterweight loaded on the carrier main body as the weight loadage index value may be used as the loadage detector. Instead of the stroke meter, a measuring device that measures the distance from the carrier main body to the top position of the counterweight loaded on the carrier main body as the weight loadage index value using a laser or an infrared ray may be adopted as the loadage detector. A limit switch that detects a height position of the top portion of counterweight loaded on the carrier main body as the weight loadage index value may be adopted as the loadage detector. An image recognizing device that photographs the counterweight loaded on the carrier main body and analyzes an image of the counterweight to thereby derive the number of loading stages of the counterweight as the weight loadage index value may be used as the loadage detector. A radio frequency identifier (RFID) tag may be attached to the counterweight. A device that detects the number of loading stages of the counterweight loaded on the carrier main body as the weight loadage index value through radio communication with the RFID tag of the counterweight loaded on the carrier main body may be used as the loadage detector.

Overview of the Embodiment and the Modifications

The embodiment and the modifications are summarized as explained below.

A mobile crane according to the embodiment and the modifications includes: a crane main body including a lower traveling body capable of self-traveling on a traveling surface, and an upper swing body mounted on the lower traveling body to be capable of swinging around a swing center axis orthogonal to the traveling surface; a counterweight carrier capable of traveling following a movement of the crane main body, the counterweight carrier including a carrier main body on which a counterweight is loaded and a wheel unit attached to the carrier main body and including wheels capable of rolling on the traveling surface; a wheel driving device configured to rotate the wheels to thereby cause the counterweight carrier to travel, the wheel driving device being capable of changing a driving force for rotating the wheels; a loadage detector configured to detect a weight loadage index value, which is an index value of weight of the counterweight loaded on the carrier main body; and a controller configured to cause the wheel driving device to change the driving force of the wheel driving device for rotating the wheels such that the driving force increases as the weight loadage index value detected by the loadage detector increases.

In the mobile crane, the controller changes, according to the weight loadage which is the index value of the weight of the counterweight loaded on the carrier main body of the counterweight carrier, the driving force for rotating the wheels included in the wheel unit of the counterweight carrier. Therefore, it is possible to drive the counterweight carrier to travel with a proper driving force irrespective of counterweight loadage. Specifically, when the weight loadage index value is large, by increasing the driving force according to the weight loadage index value, it is possible to cause the counterweight carrier to travel with a sufficient driving force irrespective of large counterweight loadage. On the other hand, when the counterweight loadage index value is small, by reducing the driving force according to the counterweigh loadage index value, it is possible to reduce a loss of energy for the driving of the counterweight carrier and prevent an excessive driving force from hindering synchronization of the crane main body and the counterweight carrier.

Specifically, it is desirable that the wheel driving device has a plurality of driving modes, a different driving force capable of rotating the wheels set in each of the plurality of driving modes, and the controller selects, as the weight loadage index value detected by the loadage detector increases, a driving mode in which a larger driving force is set as the driving force capable of rotating the wheels, and the controller causes the wheel driving device to rotate the wheels with a driving force set in the selected driving mode. Such control by the controller makes it possible to cause, with a simple control operation of selecting an appropriate driving mode out of the plurality of driving modes, the counterweight carrier to travel with a driving force corresponding to the counterweight loadage.

The counterweight carrier may have a plurality of carrier traveling modes corresponding to different movements of the crane main body, a certain carrier traveling mode which corresponds to the movement of the crane main body being selected from the plurality of carrier traveling modes. For example, the counterweight carrier may have a swing traveling mode in which the counterweight carrier travels in a swing direction of the upper swing body following a swing of the upper swing body and a translation traveling mode in which the counterweight carrier travels to be translated with the lower traveling body following traveling of the lower traveling body. In this case, it is desirable that the controller causes the wheel driving device to change the driving force on the basis of the carrier traveling mode selected from the plurality of carrier traveling modes as well as on the basis of the weight loadage index value detected by the loadage detector.

For example, when the plurality of carrier traveling modes include the swing traveling mode and the translation traveling mode, it is desirable that, when the selected carrier traveling mode is the swing traveling mode and a certain weight loadage index value is detected by the loadage detector, the controller causes the wheel driving device to rotate the wheels with a first driving force, and when the selected carrier traveling mode is the translation traveling mode and a weight loadage index value same as the certain weight loadage index is detected by the loadage detector, the controller causes the wheel driving device to rotate the wheels with a second driving force larger than the first driving force.

The wheel driving device is desirably, for example, a wheel driving device including a hydraulic pump configured to discharge hydraulic oil, a hydraulic motor coupled to the wheels and operates to rotate the wheels by being supplied with the hydraulic oil discharged from the hydraulic pump, and a relief circuit configured to allow a part of the hydraulic oil discharged from the hydraulic pump to escape to a tank without supplying the part of the hydraulic oil to the hydraulic motor, the relief circuit including a plurality of relief valves having respective set pressures different from one another and a relief selection valve configured to selectively enable any one of the relief valves to thereby allow the hydraulic oil to escape to the tank through the enabled relief valve. In this case, by the controller causing the relief selection valve to enable a relief valve having a set pressure corresponding to the weight loadage index value detected by the loadage detector among the plurality of relief valves, driving of the counterweight carrier with a relief pressure corresponding to counterweight loadage, that is, a driving pressure corresponding to the counterweight loadage can be realized.

As explained above, according to the embodiment and the modifications, by changing the driving force for the traveling of the counterweight carrier according to the weight of the counterweight loaded on the counterweight carrier, it is possible to perform proper driving of the counterweight carrier irrespective of the weight of the counterweight.

This application is based on Japanese Patent application No. 2015-145699 filed in Japan Patent Office on Jul. 23, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A mobile crane comprising:

a crane main body including a lower traveling body capable of self-traveling on a traveling surface, and an upper swing body mounted on the lower traveling body to be capable of swinging around a swing center axis orthogonal to the traveling surface;

a counterweight carrier capable of traveling following a movement of the crane main body, the counterweight carrier including a carrier main body on which a counterweight is loaded and a wheel unit attached to the carrier main body and including wheels capable of rolling on the traveling surface;

a wheel driving device configured to rotate the wheels to thereby cause the counterweight carrier to travel, the wheel driving device being capable of changing a driving force for rotating the wheels;

a loadage detector configured to detect a distance from the carrier main body to a top position of the counterweight loaded on the carrier main body; and a controller configured to cause the wheel driving device to change the driving force of the wheel driving device for rotating the wheels such that the driving force increases as the distance detected by the loadage detector increases.

2. The mobile crane according to claim 1, wherein the wheel driving device has a plurality of driving modes, a different driving force capable of rotating the wheels set in each of the plurality of driving modes, and the controller selects, as the distance detected by the loadage detector increases, a driving mode in which a larger driving force is set as the driving force capable of rotating the wheels, and the controller causes the wheel driving device to rotate the wheels with a driving force set in the selected driving mode.

3. The mobile crane according to claim 2, wherein the wheel driving device includes a hydraulic pump configured to discharge hydraulic oil, a hydraulic motor coupled to the wheels and operates to rotate the wheels by being supplied with the hydraulic oil discharged from the hydraulic pump, and a relief circuit configured to allow a part of the hydraulic oil discharged from the hydraulic pump to escape to a tank without supplying the part of the hydraulic oil to the hydraulic motor, the relief circuit including a plurality of relief valves having respective set pressures different from one another and a relief selection valve configured to selectively enable any one of the relief valves to thereby allow the hydraulic oil to escape to the tank through the enabled relief valve, and the controller causes the relief selection valve to enable a relief valve having a set pressure corresponding to the distance detected by the loadage detector among the plurality of relief valves.

4. The mobile crane according to claim 1, wherein the counterweight carrier has a plurality of carrier traveling modes corresponding to different movements of the crane main body, a certain carrier traveling mode which corresponds to the movement of the crane main body being selected from the plurality of carrier traveling modes, and the controller causes the wheel driving device to change the driving force on the basis of the selected carrier traveling mode as well as on the basis of the distance detected by the loadage detector.

5. The mobile crane according to claim 4, wherein the plurality of carrier traveling modes include a swing traveling mode in which the counterweight carrier travels in a swing direction of the upper swing body following swing of the upper swing body and a translation traveling mode in which the counterweight carrier travels to be translated with the lower traveling body following traveling of the lower traveling body, when the selected carrier traveling mode is the swing traveling mode and a certain distance is detected by the loadage detector, the controller causes the wheel driving device to rotate the wheels with a first driving force, and when the selected carrier traveling mode is the translation traveling mode and a distance same as the certain distance is detected by the loadage detector, the controller causes the wheel driving device to rotate the wheels with a second driving force larger than the first driving force.

6. The mobile crane according to claim 1, wherein the wheel driving device is configured to rotate the wheels about a steering axis, and the distance is detected by the loadage detector along the steering axis.

7. The mobile crane according to claim 1, wherein the loadage detector includes a detector main body attached to the carrier main body and a detection wire configured to be drawn out from the detector main body, the detector main body is attached to the top position of the counterweight, and the detector main body is configured to measure a length of the wire drawn out from the detector main body to determine the distance from the carrier main body to the top position of the counterweight.

8. A mobile crane comprising:

a crane main body including a lower traveling body capable of self-traveling on a traveling surface, and an upper swing body mounted on the lower traveling body to be capable of swinging around a swing center axis orthogonal to the traveling surface;

a counterweight carrier capable of traveling following a movement of the crane main body, the counterweight carrier including a carrier main body on which a counterweight is loaded and a wheel unit attached to the carrier main body and including wheels capable of rolling on the traveling surface;

a wheel driving device configured to rotate the wheels to thereby cause the counterweight carrier to travel, the wheel driving device being capable of changing a driving force for rotating the wheels;

a loadage detector configured to detect a weight loadage index value, which is an index value of weight of the counterweight loaded on the carrier main body; and a controller configured to cause the wheel driving device to change the driving force of the wheel driving device for rotating the wheels such that the driving force increases as the weight loadage index value detected by the loadage detector increases, wherein the wheel driving device has a plurality of driving modes, a different driving force capable of rotating the wheels set in each of the plurality of driving modes, the controller selects, as the weight loadage index value detected by the loadage detector increases, a driving mode in which a larger driving force is set as the driving force capable of rotating the wheels, and the controller causes the wheel driving device to rotate the wheels with a driving force set in the selected driving mode, the wheel driving device includes a hydraulic pump configured to discharge hydraulic oil, a hydraulic motor coupled to the wheels and operates to rotate the wheels by being supplied with the hydraulic oil discharged from the hydraulic pump, and a relief circuit configured to allow a part of the hydraulic oil discharged from the hydraulic pump to escape to a tank without supplying the part of the hydraulic oil to the hydraulic motor, the relief circuit including a plurality of relief valves having respective set pressures different from one another and a relief selection valve configured to selectively enable any one of the relief valves to thereby allow the hydraulic oil to escape to the tank through the enabled relief valve, and the controller causes the relief selection valve to enable a relief valve having a set pressure corresponding to the weight loadage index value detected by the loadage detector among the plurality of relief valves.

9. The mobile crane according to claim 8, wherein the counterweight carrier has a plurality of carrier traveling modes corresponding to different movements of the crane main body, a certain carrier traveling mode which corresponds to the movement of the crane main body being selected from the plurality of carrier traveling modes, and the controller causes the wheel driving device to change the driving force on the basis of the selected carrier traveling mode as well as on the basis of the weight loadage index value detected by the loadage detector.

10. The mobile crane according to claim 9, wherein the plurality of carrier traveling modes include a swing traveling mode in which the counterweight carrier travels in a swing direction of the upper swing body following swing of the upper swing body and a translation traveling mode in which the counterweight carrier travels to be translated with the lower traveling body following traveling of the lower traveling body, when the selected carrier traveling mode is the swing traveling mode and a certain weight loadage index value is detected by the loadage detector, the controller causes the wheel driving device to rotate the wheels with a first driving force, and when the selected carrier traveling mode is the translation traveling mode and a weight loadage index value same as the certain weight loadage index value is detected by the loadage detector, the controller causes the wheel driving device to rotate the wheels with a second driving force larger than the first driving force.

* * * * *